US009132901B1

(12) United States Patent
Clesceri

(10) Patent No.: US 9,132,901 B1
(45) Date of Patent: Sep. 15, 2015

(54) EXTERNAL WATER PICKUP FOR BOATS

(71) Applicant: Michael Clesceri, Oakwood Hills, IL (US)

(72) Inventor: Michael Clesceri, Oakwood Hills, IL (US)

( * ) Notice: Subject to any disclaimer, the term of this patent is extended or adjusted under 35 U.S.C. 154(b) by 0 days.

(21) Appl. No.: 14/487,570

(22) Filed: Sep. 16, 2014

Related U.S. Application Data

(60) Provisional application No. 61/892,103, filed on Oct. 17, 2013.

(51) Int. Cl.
*B63H 21/38* (2006.01)
*F01P 3/20* (2006.01)
*F02B 61/04* (2006.01)

(52) U.S. Cl.
CPC ..... *B63H 21/383* (2013.01); *F01P 3/202* (2013.01); *F02B 61/045* (2013.01)

(58) Field of Classification Search
CPC ..... F01P 3/202
USPC ..... 440/88 M, 88 C
See application file for complete search history.

(56) References Cited

U.S. PATENT DOCUMENTS 4,371,351 A * 2/1983 Tousey ..... 440/88 M
4,735,590 A * 4/1988 Mondek ..... 440/88 L
5,304,079 A * 4/1994 Karls ..... 440/88 R
5,340,345 A * 8/1994 Brodbeck et al. ..... 440/75
5,628,273 A * 5/1997 Crouse, II ..... 114/343
5,766,046 A * 6/1998 Ogino ..... 440/78
5,788,547 A * 8/1998 Ozawa et al. ..... 440/89 R
6,089,933 A * 7/2000 Cotton ..... 440/88 M
6,106,344 A * 8/2000 Mashiko ..... 440/89 R
6,210,243 B1 * 4/2001 Nakase ..... 440/88 R
6,241,566 B1 * 6/2001 Kermis et al. ..... 440/76
6,253,696 B1 * 7/2001 Mashiko ..... 114/55.5
6,468,120 B1 * 10/2002 Hasl et al. ..... 440/61 R
6,478,644 B1 * 11/2002 Ozawa et al. ..... 440/89 R
6,808,432 B1 * 10/2004 Davis et al. ..... 440/88 C
7,097,522 B1 * 8/2006 Scherer et al. ..... 440/88 M

* cited by examiner

*Primary Examiner* — Lars A Olson
*Assistant Examiner* — Jovon Hayes
(74) *Attorney, Agent, or Firm* — Knechtel, Demeur & Samlan

(57) ABSTRACT

A water pickup device for providing cooling water to a cooling system for an internal combustion engine in a boat by drawing cooling water from the surrounding water in which the boat is floating. A moveable water intake tube is mounted in a housing mounted to the hull of the boat. The intake tube provides a fluid passageway from the surrounding water to the engine cooling system. The intake tube automatically moves up or down in response to the speed of the boat moving through the water. This provides constant water pressure to the cooling system while providing minimum drag on the boat at high speeds.

19 Claims, 3 Drawing Sheets

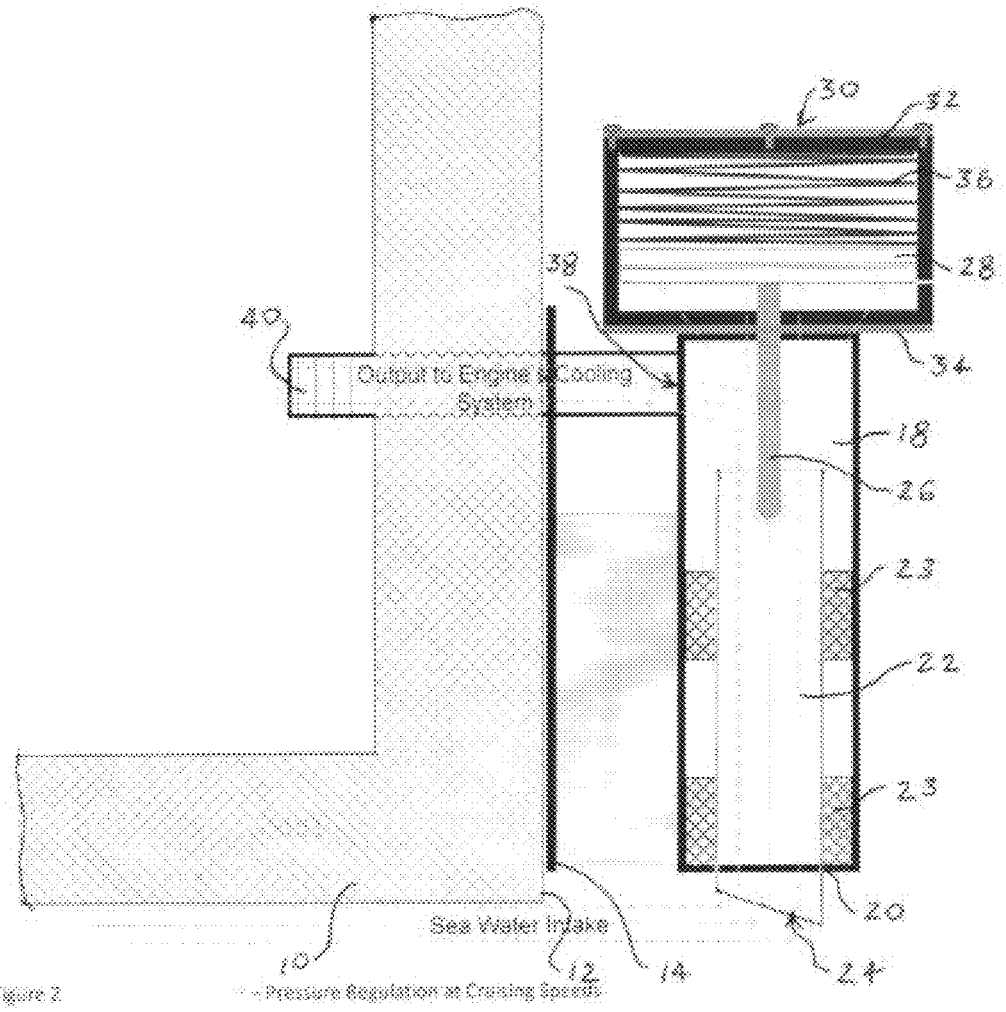
Figure 2 - - Pressure Regulation at Cruising Speeds

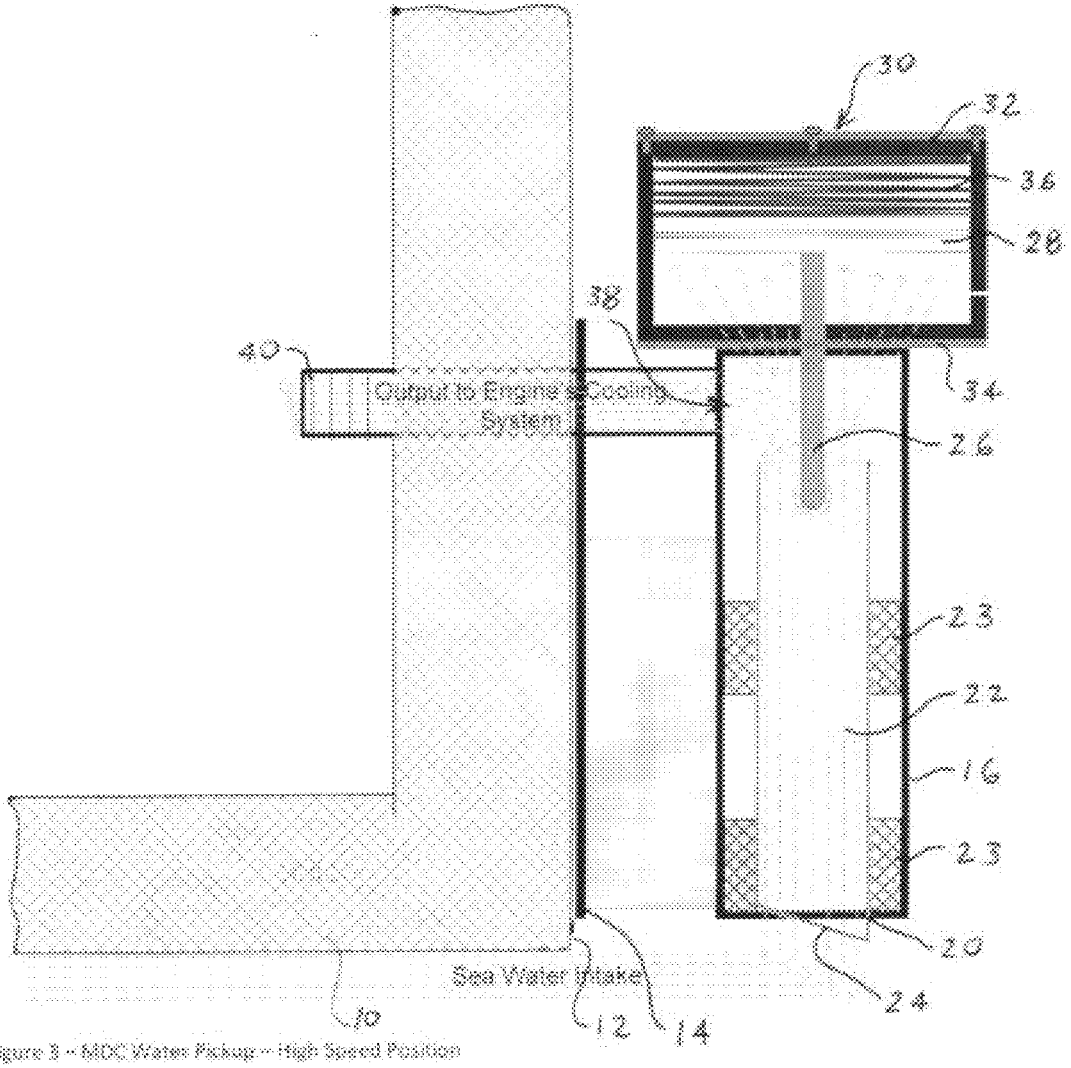
Figure 3 – MDC Water Pickup – High Speed Position

EXTERNAL WATER PICKUP FOR BOATS

CROSS-REFERENCE TO RELATED APPLICATION

This application is based on and claims priority of provisional patent application 61/892,103 filed Oct. 17, 2003.

FIELD OF THE INVENTION

This invention is directed to a device that is mounted to the transom of a speed boat to collect water that is then routed to the engine for cooling.

BACKGROUND OF THE INVENTION

Unlike an automobile that uses an air-to-coolant heat exchanger (i.e. a radiator) to maintain proper operating temperatures, marine engines use sea water to either directly cool the engine (raw water cooling) or a sea water-to-coolant heat exchanger (closed water cooling). Both systems require a constant flow of sea water to prevent overheating and ultimately engine damage.

The options for collecting engine cooling water for offshore performance boats are limited to three methods. The most common is to use the built-in water passages that are available on most stern drives from the factory. This is adequate for most applications since the water pickups are, by design, are placed in an area that has a good flow but lower pressures such as on the contour of a housing or on the backside of a gear case.

In applications where stern drive intakes are not available, such as surface drives or shaft drives, then either a through hull pickup or externally mounted water pickups are the only option. A through hull water pickup is by far the best option but determining the exact location in the hull of a step bottom boat is challenging and typically only installed at the factory on very high speed catamarans.

The result is that the most common, non-stern drive mounted, water pickup is externally fastened to the transom at the bottom edge of the hull. Most are mounted in a fixed position but some have adjustable brackets that allow the pickup tube to be moved up and down in relation to the bottom of the hull. One would think that one can solve the problem by mounting the water pickup well below the surface of the water. However, this is not the case, particularly at the speeds many performance boats are capable of these days. A poorly designed or mounted water pickup can generate extreme water pressures in the engine's cooling system, at even modest speeds. The dynamic pressure generated by a fully submerged water pickup moving at 80 MPH is 93 PSI, which is more than four times the required pressure. Such extreme water pressure can lead to burst hoses and can sink a boat in a very short period of time. In raw water cooled engines the extreme pressure can damage head gaskets and literally fill the engine block with water in a matter of seconds. A raw water cooled engine typically requires less than 20 PSI so clearly one cannot simply mount them below the bottom of the boat and maintain safe water pressures.

The boat's trim and the water conditions also play a factor and can lead to "dead spots" where the water pressure is inadequate for the speed and trim angle at which the boat is being operated. For example, running in moderate seas, the operator will likely reduce speed and trim the boat down to have the bow break the waves sooner for a smoother ride. A pickup that is positioned for proper pressures a high speeds will likely experience low water pressure under these bow down conditions, forcing the operator to comprise the ride quality for water pressure.

External water pickup placement that is optimized for flow will most likely reduce boat speed due to the increased hydrodynamic drag from the pickup being placed below the bottom of the hull. At high speeds this condition can lead to excessive pressure. Water pickup placement that is optimized for operating at high speeds almost certainly leads to poor water flow at midrange and cruising speeds that can melt the rubber exhaust hoses and release hot exhaust into the engine compartment or cause the engine damage due to overheating.

There are adjustable water pickups on the market but these require that the boat be removed from the water to make the adjustment and they are still a compromise between too much and too little water pressure. Some race boats have designed water pickups that can be adjusted via cable and lever in the cockpit. However, these require constant monitoring of the water pressure and adjustment of the pickup. Making the manual adjustments is a little easier to do in a race boat that always has two drivers onboard.

The most popular way of managing the water pressure is to install a pressure regulator on the water line leading from the pickup to the engine. When the pressure exceeds a set value the valve opens and allows the excess water to be routed overboard. This solution requires that the water pickup be mounted well below the bottom of the boat to ensure good water flow under all operating conditions. However, these valves do not address the issue of the increased drag caused by the extended water pickup. Another disadvantage is that they require extra plumbing and a thru-hull fitting for the water dump.

As can be seen, the prior art has not solved the problem of providing a simple and automatic solution for providing an automatic water pickup that adjusts for pressure. Manually adjusting the pickup height will solve the problem, but this isn't a practical solution in a recreation boat. The pressure regulator will dump the excess pressure but does not reduce the drag caused by a water pickup that is mounted far enough below the hull as to produce adequate water pressure under all conditions. It is believed that this drag can reduce the boat speed by at least three to five MPH. In most boats one would have to increase engine output by 50-100 HP to produce a five 5 MPH gain in speed.

SUMMARY OF THE INVENTION

Applicant's invention provides a self-regulating water pickup that automatically adjusts the depth of the pickup relative to the hull that will produce adequate water pressure at any speed or hull attitude while providing the minimum drag. This is accomplished by a piston that is connected to a movable water pickup. Water pressure enters the cylinder through the pickup tube and acts upon the piston. This force is countered by that of a calibrated spring such that the when the water pressure is excessive the spring is compressed and the water pickup moves higher out of the water until the pressures are balanced again. When the water pressure drops, the spring expands and the water pickup moves lower into the water until the pressures are balanced. Basically, instead of dumping the excess water pressure overboard the inventive device uses that pressure to raise the water pickup tube, which will reduce the pressure and reduce the drag.

The invention eliminates water pressure issues in offshore performance boats. Unlike Applicant's invention, all prior external water pickup designs are a compromise and cannot be optimized for all conditions.

BRIEF DESCRIPTION OF THE DRAWINGS

FIG. 2 is a schematic drawing of the inventive water pickup with the pickup tube in the middle position simulating cruising speeds.

FIG. 3 is a schematic drawing of the inventive water pickup with the pickup tube in the highest or fully refracted position simulating high speed operation.

DESCRIPTION OF THE PREFERRED EMBODIMENT

Figure 1:
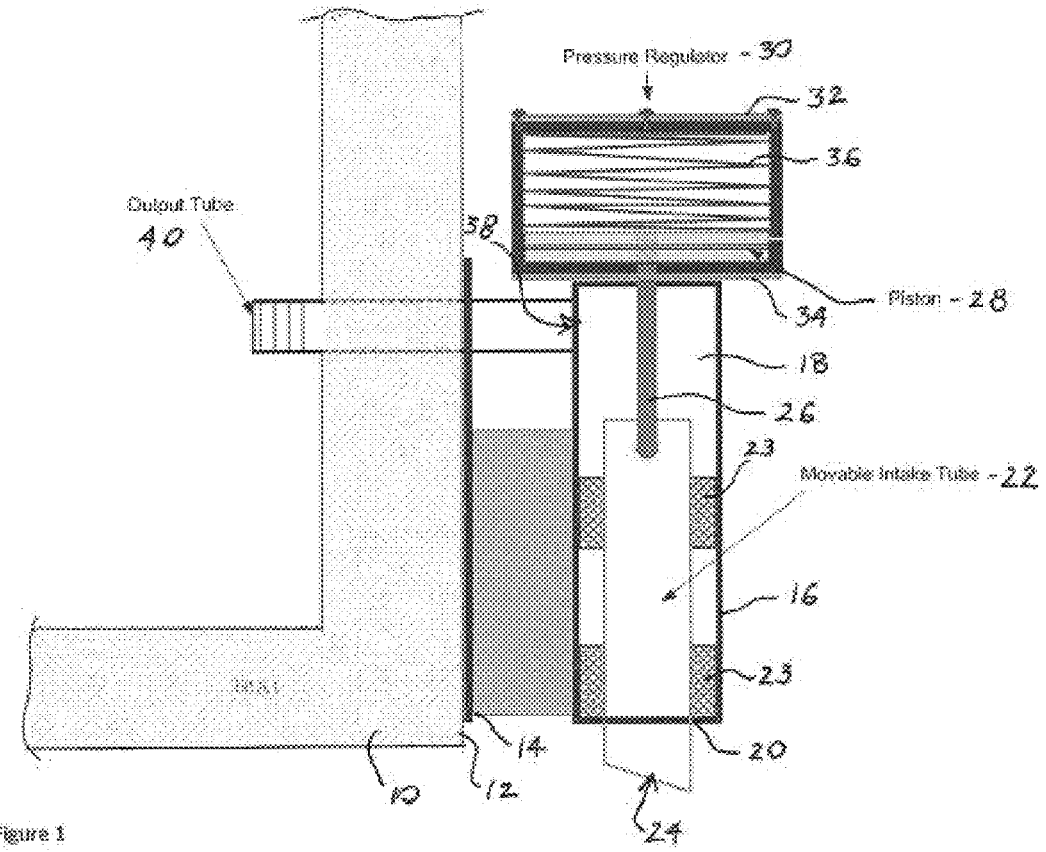
FIG. 1 is a schematic drawing of the inventive water pickup with the pickup tube in the lowest or fully extended position below the hull.

Turning first to FIG. 1, the water pickup is illustrated in the "at rest" or slow moving position. The hull 10 has a transom 12. A mounting bracket or other suitable mounting means 14 connects a housing 16 to the hull 10. The housing 16 has a water receiving chamber 18, and a partially open bottom 20 through which passes a moveable water intake tube 22. The intake tube 22 is mounted in gaskets 23 in the housing 14 which allows the intake tube 22 to slide vertically in the housing 16 yet still provide a water tight seal. The intake tube 22 has an open bottom 24 through which cooling water is received from the surrounding body of water. The bottom of the intake tube 22 may be angled in order to assist in directing the cooling water up into the intake tube 22. At the top of the moveable intake tube 22 is a connecting rod 26 that has its upper end connected to a piston 28 that is mounted to a pressure regulator 30. There is a spring 36 in the pressure regulator 30 that has one end pushing against a top 32 of the pressure regulator 30 and the other end pushing against the piston 28. This causes the piston 28 to be pushed toward a bottom 34 of the pressure regulator 30, which pushes the connecting rod 26 downward, which in turn pushes the moveable water intake tube 22 downward. At the top of the housing 16 is a fluid passageway 38 that is in fluid communication with an output tube 40 that is in fluid communication with the engine cooling system. Thus water can flow through the moveable intake tube 22, into the water receiving chamber 18 in the housing 16, through the fluid passageway 38 and into the output tube 40.

When the boat is at rest or moving slowly, the moveable intake tube 22 is pushed downward toward its fully extended position as illustrated in FIG. 1. The force of water pushing against the bottom of the intake tube 22 is generally not sufficient to raise the intake tube 22. In this position the force of the external water on the intake tube 22 is at its lowest point. The pressure regulator 30 forces the intake tube 22 to its position deepest in the water which results in the intake tube 22 allowing maximum pressure to the chamber 18, to the fluid passageway 38, to the output tube 40 and ultimately to the engine cooling system.

FIG. 2 illustrates the condition where the boat is accelerating and the water pressure in the cooling system rises. As the boat increases in speed, the water flowing past the boat acts upon the moveable intake tube 22 forcing it upward. This pushes the connecting rod 26 upward and pushes the piston 28 against the spring 36 and up into the regulator 30. The force of the spring 36 in the regulator 30 thus controls the position of the water intake tube 22 which regulates the pressure of the cooling water into the output tube 40 which controls the water pressure to the engine cooling system. Thus the regulator automatically controls the pressure of the water flowing into the engine cooling system as compared to a fixed position intake tube that is not raised or lowered in response to the boat's speed.

FIG. 3 illustrates the condition where the boat is further accelerating and the pressure in the system further rises. The force of the water flowing past the hull 10 pushes the intake tube 22 to its maximum height in the housing 16. The piston 28 is also in its extreme upward position in the regulator 30. In this position the regulator 30 regulates the water pressure into the output tube 40 so that the system still receives adequate cooling water at adequate pressure to cool the engine and related components so that they are protected. Also, the water intake tube 22 is in its maximum insertion into the housing 16 so that it provides the least amount of hydrodynamic drag on the boat. This is important in performance boats where a small reduction in drag results in a substantial increase in speed with the same horsepower.

Thus there has been disclosed a self-regulating water pickup device that automatically adjusts the depth of the pickup relative to the hull that will produce adequate pressure at any speed or hull attitude while providing the least amount of drag possible all the while supplying adequate water pressure to protect the engine and related components. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A water pickup device for providing cooling water to a cooling system for an internal combustion engine in a boat from the surrounding water in which the boat is floating comprising:

a housing having a top, an open bottom and fluid receiving chamber, the housing attached to a hull of the boat;

a movable intake tube mounted in the housing, the movable intake tube having a central passageway with a lower open end protruding out the open bottom of the housing into the surrounding water and an opposite upper end inside the housing, an output tube having one end fluidly connected to the housing and the opposite end fluidly connected to the engine cooling system;

the central passageway, fluid receiving chamber and output tube defining a fluid passageway for providing cooling water from the surrounding water to the cooling system;

means for providing a downward force to the moveable intake tube to move the moveable intake tube to a lower first position out the open bottom of the housing into the surrounding water when the boat is at rest;

the movable intake tube moving up in the housing to a second position higher than the first position in response to the force of the surrounding cooling water moving past the boat when the boat accelerates;

the movement of the moveable intake tube controlling the pressure of the cooling water entering the fluid passageway.

2. The water pickup device of claim 1 wherein the means for providing a downward force to the moveable intake tube comprises a pressure regulator for controlling the position of the movable intake tube in the housing for regulating the pressure of the cooling water to the fluid passageway.

3. The water pickup device of claim 2 wherein the pressure regulator comprises a spring providing a force to a piston that is mechanically connected to the moveable intake tube to provide the downward force against the moveable intake tube.

4. The water pickup device of claim 3 wherein the moveable intake tube moves upward against the spring when the force exerted on the moveable intake tube by the surrounding cooling water moving past the boat exceeds the downward force of the spring.

5. The water pickup device of claim 3 and further comprising a connecting rod connecting the upper end of the moveable intake tube to the piston.

6. The water pickup device of claim 4 wherein the amount of movement of the intake tube is dependent on the speed of the boat as it moves through the surrounding water.

7. The water pickup device of claim 1 wherein the lower end of the moveable tube is raised into the housing when the speed of the boat increases to a predetermined speed to lessen the drag on the boat, yet still provide sufficient pressure of the cooling water into the fluid passageway.

8. The water pickup device of claim 1 wherein the lower open end of the intake tube is contoured to direct the flow of the cooling water up into the central passageway.

9. A water collection device for providing cooling water to an internal combustion engine of a boat comprising:

a water intake tube mounted to a hull of a boat;

the water intake tube having an open bottom and a passageway for receiving water at its open bottom and discharging the water to a discharge tube that is fluidly connected to the combustion engine cooling system, the water intake tube extending below the hull when the boat is at a first low speed, the water intake tube automatically raising to a raised position when the boat is at a second increased speed, the tube moving in response to a increase in water pressure exerted by water flowing past the boat on the water intake tube as the boat increases in speed; and a pressure regulator for automatically controlling the amount that the tube raises or lowers when the speed of the boat is increased or decreased respectively.

10. The water collection device of claim 9 wherein the pressure regulator comprises a spring providing a force to a piston that is mechanically connected to the water intake tube to provide a downward force against the water intake tube.

11. The water collection device of claim 10 wherein the water intake tube moves upward against the spring when the force exerted on the water intake tube by the surrounding cooling water moving past the boat exceeds the downward force of the spring.

12. The water collection device of claim 10 wherein the water intake tube moves downward due to the force of the spring exceeding the force exerted upward on the water intake tube by the surrounding cooling water moving past the boat.

13. The water collection device of claim 9 and further comprising a housing in which the water intake tube is mounted and the housing is mounted to the boat.

14. The water collection device of claim 13 wherein the lower open bottom of the intake tube is contoured to direct the flow of the cooling water up into the central passageway.

15. A water pickup device for providing cooling water to a cooling system for an internal combustion engine in a boat from the surrounding water in which the boat is floating comprising:

a water intake tube mounted to a hull of a boat;

the water intake tube having an open bottom and a passageway for receiving water at its open bottom and discharging the water to a discharge tube that is fluidly connected to the combustion engine cooling system, the water intake tube extending below the hull when the boat is at rest;

means for allowing the water intake tube to move vertically upward to a first position when the boat moves forward at a first low speed;

means for allowing the water intake tube to automatically move further vertically upward to a second position when the boat moves forward at a second speed greater than the first speed, the tube moving in response to an increase in water pressure exerted by the surrounding water flowing past the boat on the water intake tube; and a pressure regulator for automatically controlling the distance that the tube raises or lowers when the speed of the boat is increased or decreased respectively.

16. The water collection device of claim 15 wherein the means for allowing the water intake tube to automatically move vertically is a housing surrounding the water intake tube and a plurality of spacing elements mounted between the housing and the water intake tube which allow the water intake tube to slide vertically.

17. The water collection device of claim 16 wherein the discharge tube is fluidly connected to the housing.

18. The water collection device of claim 17 wherein the pressure regulator comprises a spring providing a force to a piston that is mechanically connected to the water intake tube to provide a downward force against the water intake tube.

19. The water pickup device of claim 15 wherein the lower open bottom of the intake tube is contoured to direct the flow of the cooling water up into the central passageway.

* * * * *